US008733564B2

(12) United States Patent
Fitzgerald et al.

(10) Patent No.: US 8,733,564 B2
(45) Date of Patent: May 27, 2014

(54) VARIABLE CONFIGURATION SHELVING APPARATUS AND METHODS

(75) Inventors: Scott Fitzgerald, Lowell, IN (US); David J. Wojtowicz, Orland Park, IL (US); Thomas St. Germain, Bridgeview, IL (US); Mitchell Liss, Northbrook, IL (US); Al Dunaj, Chicago, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 219 days.

(21) Appl. No.: 12/829,746

(22) Filed: Jul. 2, 2010

(65) Prior Publication Data

US 2012/0000873 A1 Jan. 5, 2012

(51) Int. Cl.
*A47B 43/00* (2006.01)

(52) U.S. Cl.
USPC ..... 211/191

(58) Field of Classification Search
USPC ..... 211/134, 135, 182, 183, 187, 189, 186, 211/190, 191, 192, 193, 151, 126.15; 108/151, 155, 12, 107, 147.17, 159
See application file for complete search history.

(56) References Cited

U.S. PATENT DOCUMENTS

| | | | | | |
|---|---|---|---|---|---|
| 1,288,010 | A * | 12/1918 | Isaac | 108/147.17 |
| 1,380,570 | A * | 6/1921 | Lehman | 211/60.1 |
| 2,788,949 | A * | 4/1957 | Gurries | 248/242 |
| 3,029,056 | A * | 4/1962 | Breglia | 248/243 |
| 3,070,237 | A * | 12/1962 | Fullerton et al. | 211/192 |
| 3,303,937 | A * | 2/1967 | McConnell | 211/192 |
| 3,587,483 | A * | 6/1971 | Konstant | 108/157.13 |
| 3,862,691 | A * | 1/1975 | Mori et al. | 211/191 |
| 4,342,397 | A * | 8/1982 | Halstrick | 211/191 |
| 5,011,031 | A * | 4/1991 | Konstant | 211/191 |
| 5,749,481 | A * | 5/1998 | Miller | 211/191 |
| 2005/0103733 | A1* | 5/2005 | Saltzberg et al. | 211/187 |
| 2005/0103734 | A1* | 5/2005 | Saltzberg et al. | 211/187 |
| 2011/0272373 | A1* | 11/2011 | Wojtowicz et al. | 211/134 |

* cited by examiner

*Primary Examiner* — Jonathan Liu
*Assistant Examiner* — Patrick Hawn
(74) *Attorney, Agent, or Firm* — Wood, Herron & Evans, LLP

(57) ABSTRACT

A variable configuration shelving apparatus including shelf-supporting reversible beams. In one position, beam top edges are flush with a shelf thereon. In another position, the beams form upstanding lips about a shelf. Beam structure is included.

9 Claims, 8 Drawing Sheets

VARIABLE CONFIGURATION SHELVING APPARATUS AND METHODS

FIELD OF THE INVENTION

This invention relates to the field of shelving and more particularly to improved shelving components providing a variety of easily-adjustable shelf configurations.

BACKGROUND OF THE INVENTION

Consideration of efficient shelving includes the particular configuration of respective shelves and the facilitation of shelf loading and load retention. For example, a fully flat shelf surface with no upstanding edge lip may be useful in one application where it is desired to easily slide, load or unload an item onto or from the surface without obstruction from an upstanding lip. In another application, it may be desired to surround a shelf with an upstanding lip to prevent loads from easily rolling or sliding off the shelf. In yet other applications, it may be desirable to provide a shelf with no front side lip but with upstanding lips on the shelf sides and/or along the rear edge of the shelf, for the same purposes.

At the same time, it is desired to provide a shelving unit which can be shipped in flat configuration and erected on site. If the unit is to present a variety of shelves as noted above, a plurality of different shelves must be provided, increasing the number of shelves necessary for a user to customize a shelving unit for a particular application. This extends the number of shelf components necessary as well as the cost, and results in an excess of unused shelves not utilized in the desired application.

Accordingly, it has been one objective of the invention to provide an improved variable shelf apparatus having a variety of shelf configurations easily presented and capable of providing all the application varieties above, but without the need to supply extra or additional shelves for each desired configuration or application.

A further objective of the invention has been to provide an improved shelving apparatus and methods capable of presenting a variety of shelf configurations.

SUMMARY OF THE INVENTION

To these ends, a preferred embodiment of the invention contemplates provision of a shelving apparatus wherein the shelves are of identical construction and further including a plurality of shelf supporting beams which are mounted to shelf-supporting columns in different orientations to present, in combination with the shelves, a variety of shelf configurations. Thus, a variety of shelf configurations are rendered possible, not by variations in shelf structures, but by variable orientation of shelf supporting beams, which alternately define upstanding lips along predetermined shelf edges or which support the shelf without any upstanding lip above the plane of the shelf surface. Accordingly, the invention provides a shelf apparatus comprising a plurality of shelves, common shelf-supporting but reversible beams and shelf-supporting columns wherein the shelf configuration is defined or determined by the orientation of the common but reversible beams.

More particularly, the invention contemplates an improved shelf supporting beam having a shelf supporting flange extending from the beam body at a position which is nearer one elongated edge of the beam than another. When oriented in one position, the beam flange supports a shelf such that the upper edge of the beam is generally flush with the shelf surface. When oriented in a second or reverse position, the beam flange supports the shelf on another side thereof, with an edge of the beam extending above the shelf surface, defining a lip along the adjacent edge of the shelf.

Using this invention, a user can then select which if any shelf edge needs or does not need a lip and then provide that lip, or not, by orienting the position of the adjacent shelf beam between the columns.

A shelving apparatus is thus presented to provide a variety of shelf configurations accomplished by common components and without additional shelving necessary to provide a desired shelf configuration.

A unique shelf-supporting and reversible beam structure is also contemplated.

To these ends, preferred embodiments of the invention will be even more readily understood by the following written description and the drawings in which:

DETAILED DESCRIPTION OF THE INVENTION

It will be appreciated that the invention also provides an aesthetic appearance apart and differentiated from functional aspects of the claimed structure. A related design application is filed on even date herewith and is granted U.S. Ser. No. 29/365,084.

Figure 1:
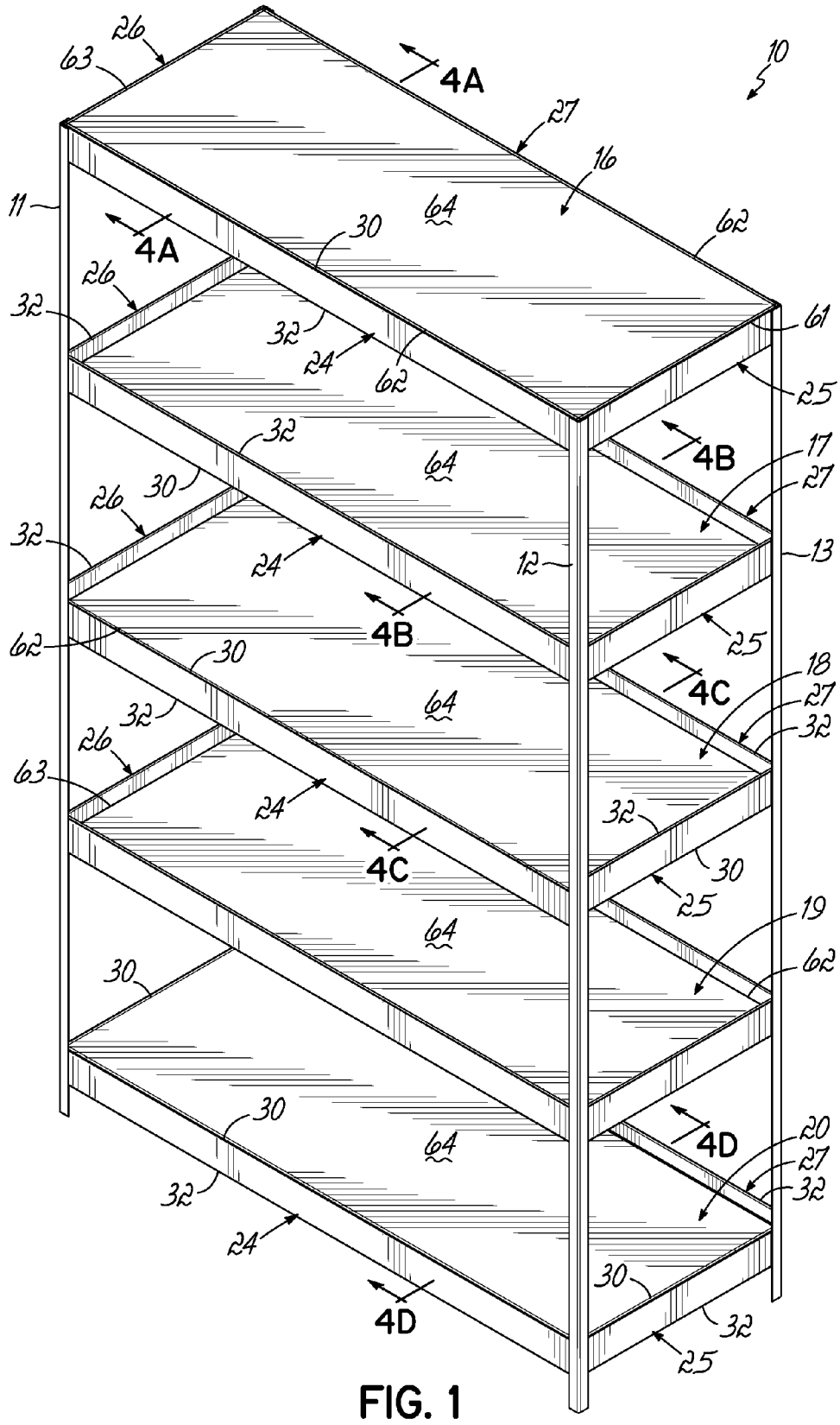
FIG. 1 is an isometric view of a shelving apparatus according to the invention.

Turning now to the drawings, there is shown in FIG. 1 a shelving apparatus 10 according to a preferred embodiment of the invention. Apparatus 10 includes four upstanding shelf-supporting columns 11-14. Apparatus 10 also includes in this embodiment five shelves 16-20 of preferably identical construction. Shelves 16-20 may be made of wood, particle board, synthetics, laminates or any suitable materials and preferably having a thickness 22 (illustrated at FIG. 2). Apparatus 10 further includes a set of four shelf-supporting beams 24-27, including a front beam 24, side beams 25, 26 and rear beam 27, for each respective shelf 16-20.

Front and rear beam 24, 27 are essentially the same length, while side beams 25, 26 are shorter than beams 24, 27, but are equal in length to each other.

It will be appreciated that while each beam 24-27 is preferably similar in construction to each other beam (excepting beam length as noted above), they are oriented in apparatus 10 in different configurations as herein noted.

Figure 3:
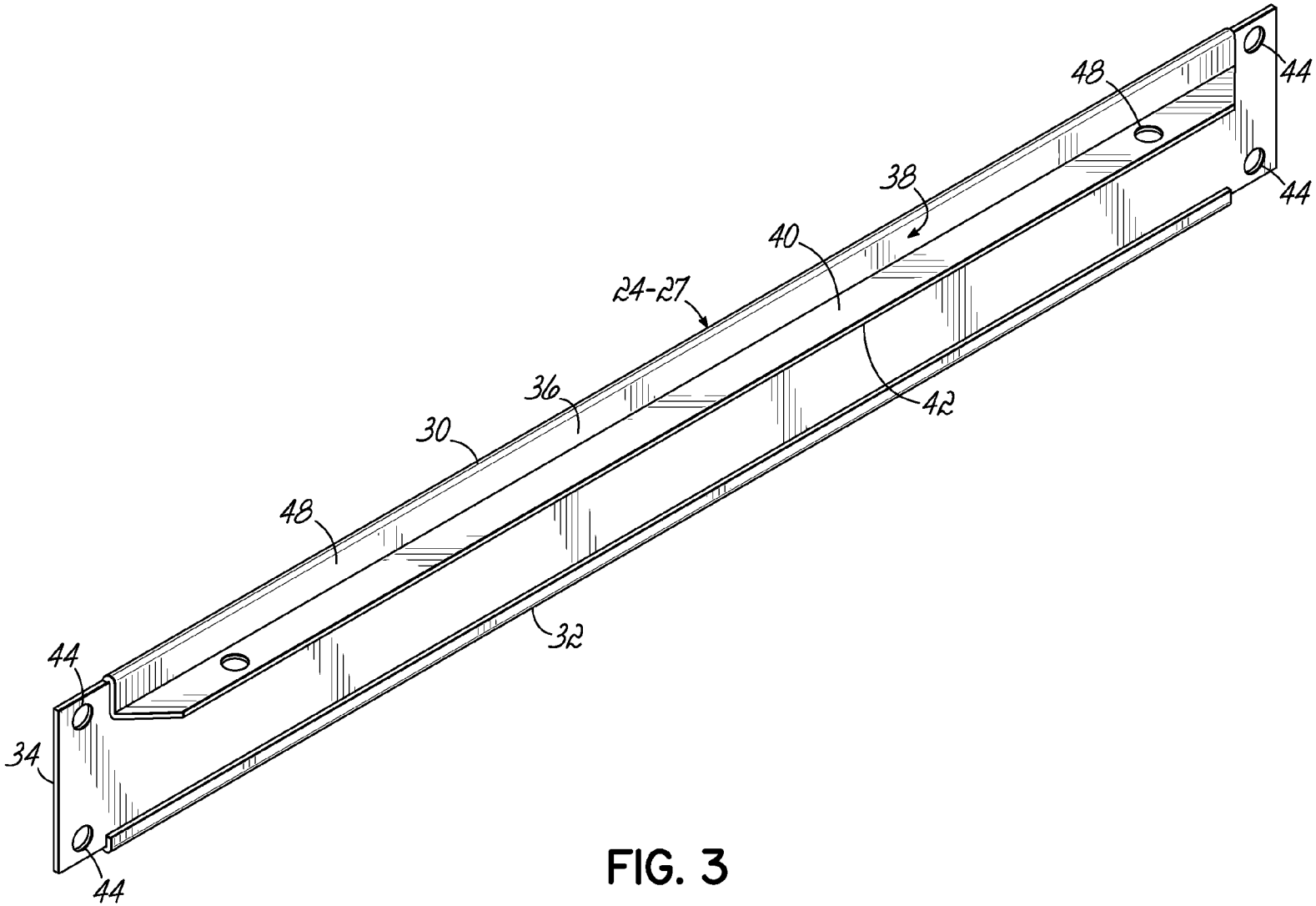
FIG. 3 is an isometric view of a shelf-supporting beam according to the invention.

FIG. 3 clearly illustrates the features common to each of preferred beams 24, 27, which are the same (excepting length) as in beams 25, 26.

Each beam 24-27 thus has a top edge 30, a bottom edge 32, and a beam web 34. Web 34 has a reversely-folded flange 36 and a shelf-supporting flange 38 extending perpendicularly therefrom. Top edge 30 is defined by the folded juncture of web 34 and reverse flange 36.

Shelf-support flange 38 has an upper shelf-support surface 40 (FIG. 3) and an opposite lower shelf-support surface 42 (FIGS. 4A-4D) on another side of flange 38. Like portions of the beams 24-27 carry like numbers for clarity. The beams 24-27 preferably have holes 44 to accommodate beam-to-column interconnection rivets 46 as will be discussed.

Holes 48 may be placed in flange 38 for accommodating appropriate fasteners (not shown) for respective shelves 16-20.

It will be appreciated that, while not shown (for clarity) in FIG. 1, columns 11-14 are in the configuration or an angle with two column flanges joined at ninety degrees. Each column flange is provided with a series of spaced apart, keyhole-shaped apertures 50, each having an enlarged portion 51 and a narrower portion 52 (see FIG. 4A, for example). The series of apertures 50 preferably run the length of the respective columns 11-14 and it will be noted the narrower portions 52 are beneath the enlarged portions 51 when the columns are vertically oriented in an assembled unit 10. Enlarged portions 51 are of a size to allow passage of the head 47 of a rivet 56, while the narrower portion 52 accommodates the shank 48 of rivets 46 (see FIGS. 4A-4D) but does not allow withdrawal of the head 47 therethrough. Head 47 is larger in periphery than can be passed thru narrow portion 52.

Apertures 50 are spaced apart preferably at the same distance as holes 44 in beams 24-27, or in some multiple or fraction thereof, such that rivets 46 in the beams 24-27 index with respective holes 50 in the columns 11-14, thus securing the respective beams 24-27 to respective columns 11-14 as will be described.

It will be appreciated that shelving unit 10 presents, for illustration, a variety of different shelf configurations (FIG. 1 and FIGS. 4A-4D). For example, top shelf 16 presents an upper flat surface as shown with respective sides 60-63. Shelf 16 is a flat surface 64 with no upstanding lip above that surface 64, sides 60-63 being flush with surface 64. Sides 60-63 are flush since top edge 30 of the beams 24-27 do not extend above surface 64.

On the other hand, shelf 17 is also defined by a similar flat surface 64, however, that surface is surrounded at its four sides by upstanding lips defined by the edge 32 of front side and rear beams 24-27 extending above the plane of surface 64 of shelf 17. In that configuration, items on surface 64 of shelf 17 are prevented from sliding or rolling off shelf 17.

Turning to shelf 18, it too has a flat shelf surface 64. In this configuration, however, the two side and rear edges of shelf 18 are surrounded by upstanding lips defined by top edges 32 of the two side beams 25, 26 and the rear beam 27. The front edge of shelf 17, i.e. top edge 30 of front beam 24, is flush with surface 64, allowing easy loading of shelf 18.

Shelf 19 and beams 24-27 are configured as shelf 17, simply illustrating that apparatus 10 can be configured in a variety of different ways, the configuration of each shelf being selectable.

Finally, the configuration of shelf 20 is yet again different. This shelf also has a flat shelf surface 64. The front and both side edges thereof are defined by top edge 30 of each beam 24, 25, 26 being flush with surface 64, but with edge 32 of reversed rear beam 27 extending above surface 64 to prevent loads from being moved over the rear edge of the shelf.

Accordingly, it will be appreciated that FIG. 1 illustrates but one of a large number of variable shelf configurations and combinations thereof.

Top shelf 16 has flush edges with no upstanding lips, shelf 17 has an upstanding lip around all four shelf edges, shelf 18 has an upstanding lip around the two sides and one rear edge, shelf 19 is like shelf 17 and shelf 20 has flush front and side edges with an upstanding lip along its rear edge.

It will be appreciated that any number of shelf configurations and any combination thereof, one with the other, are easily provided.

Apparatus 10 might include a plurality of shelves, all with the same edge or lip configuration (i.e. beam orientation), all with different edge or lip configurations or any selected combination thereof.

FIGS. 2-5 clearly illustrate components of the invention which facilitate and provide these varied configurations. In this regard, it will be appreciated that the upstanding or flush lips or edges are determined by the orientation of the respective beams 24-27 for each shelf.

Turning again momentarily to FIG. 3, each beam 24-27 has flange 38 which is disposed closer to top edge 30 than to the bottom edge 32. Top surface 40 of flange 38 is spaced from the top edge 30 a distance which is approximately the same as the thickness of a shelf to be supported there (see FIG. 2 and the shelf thickness 22, for example). Accordingly, when a shelf 16-20 is supported on surface 40 of flange 38, top edge 30 of the respective beam is flush, with, or in approximately the same plane as surface 64 of the shelf.

Thus, the top edge of beam 24-27, flush with surface 64, defines or provides a flush edge for that side, front or back sides or edges of the shelf.

Returning to FIG. 3 and FIG. 5A, note the flange 38 is spaced further from lower beam edge 32 than top beam edge 30. Accordingly, where the beam is reversed, flipped or rotated upside down from its position in FIG. 3, the lower surface 42 of flange 38 now becomes the shelf-supporting surface of the flange 38. In such an orientation, the shelf surface 64 is significantly lower than upper edge 32 of the beam so that a portion of the beam extends above surface 64, forming an upstanding lip or edge of the shelf edge thereal-ong.

The function of the beams 24-27, columns 11-14 and shelves 16-20 will now be discussed.

Rivets 46 in beams 24-27 are indexable with apertures 50 in columns 11-14 respectively, so that each individual beam can be supported by a column at a predetermined orientation, either upright with a top beam edge 30 or flipped over so that beam edge 32 is the uppermost edge and edge 30 the lowermost. When beam edge 30 is uppermost, any adjacent portion of a shelf supported on surface 40 of flange 38 is flush with top edge 30, thus defining a flush shelf edge with no lip thereal-ong. When any beam is reversed or flipped over, the shelf is supported on surface 42 of flange 38 so beam edge 32 extends above shelf surface 64, defining an upstanding lip above surface 64.

It will be appreciated that the respective shelves 16-20 are typically flat, the flush edges or upstanding lip edges being provided by the orientation of the beam along the adjacent shelf portion.

Turning to the cross-section views of FIGS. 4A-4D, portions of the apparatus 10 and shelves 16, 17, 18 and 20 are illustrated for further understanding.

Figure 4A:
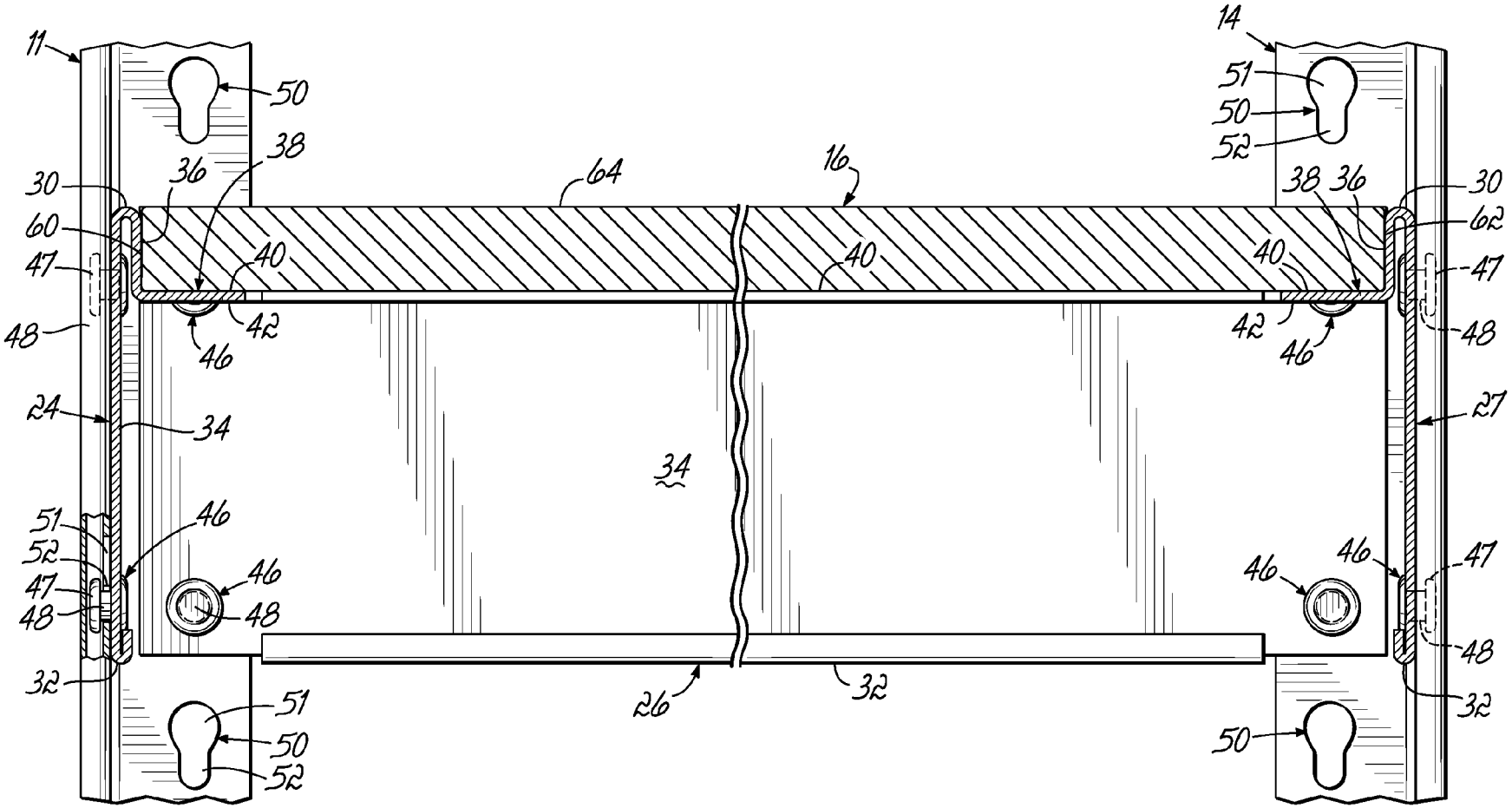
FIG. 4A is a cross-sectional view taken along lines 4A-4A of FIG. 1.

FIG. 4A illustrates the front beam 24, rear beam 27 and side beam 26, all mounted on columns 11, 14 to provide a shelf 16 with no upstanding lips, but rather flush edges. Rivets 46 hold beams 24, 26, 27 on the respective column with top edges 30 higher than lower edge 32. Shelf 16 is supported on respective upper surfaces 40 of flanges 38. In this configuration, all beams are similarly oriented. It will be appreciated that the beams are introduced to the columns with rivet heads 47 extending through enlarged portions 51 of apertures 50. The rivet shanks are lowered into narrow portions 52 to secure the respective beam onto a column.

Figure 4B:
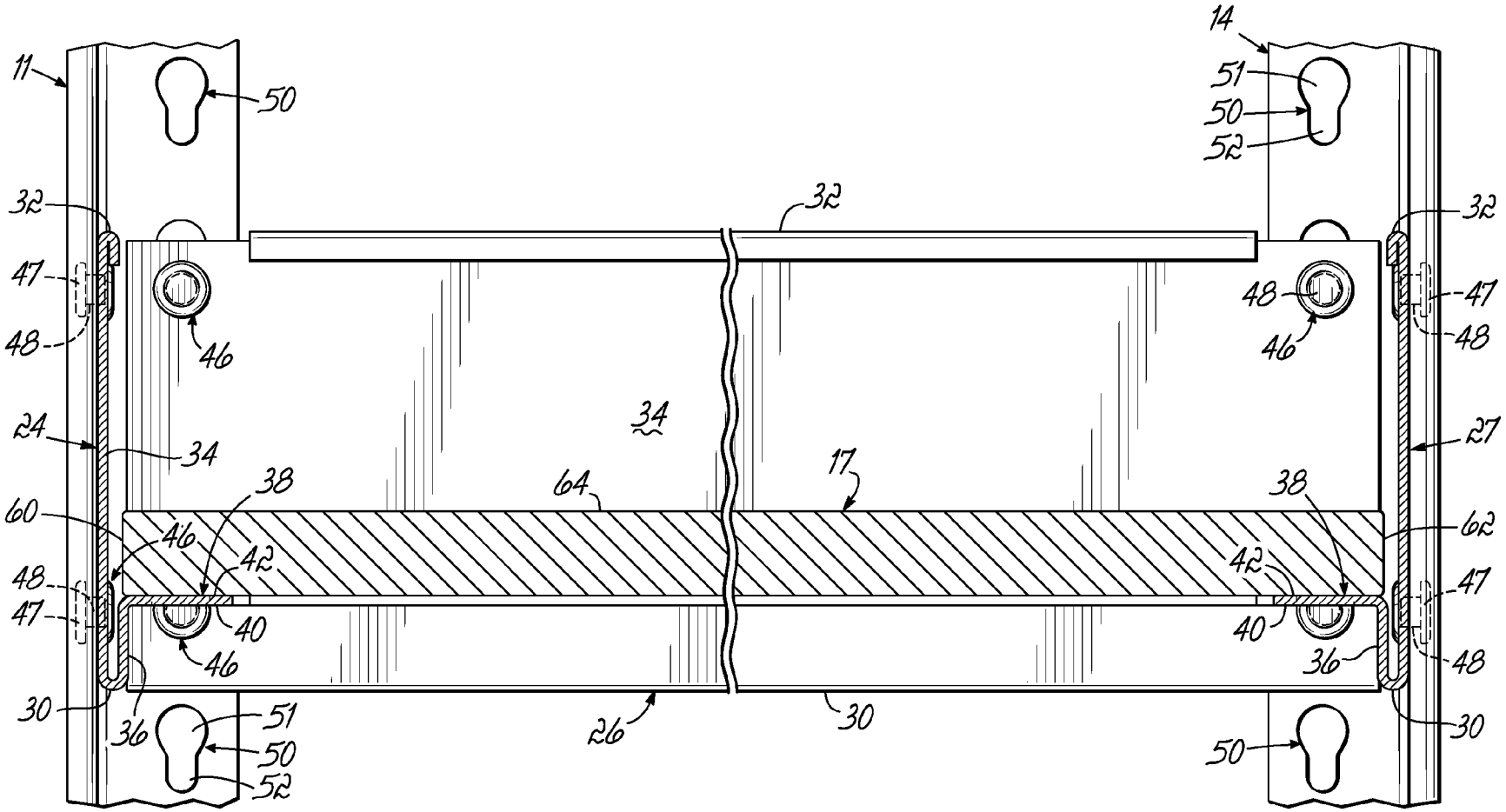
FIG. 4B is a cross-sectional view taken along lines 4B-4B of FIG. 1.

FIG. 4B illustrates a cross-section of shelf 17 wherein each beam is flipped with edge 32 uppermost, and edge 30 lowermost, the beams defining an upstanding lip around the entire shelf on front, sides and rear thereof. The extent of the lip is defined by the distance between shelf surface 64 and beam edge 32.

Figure 4C:
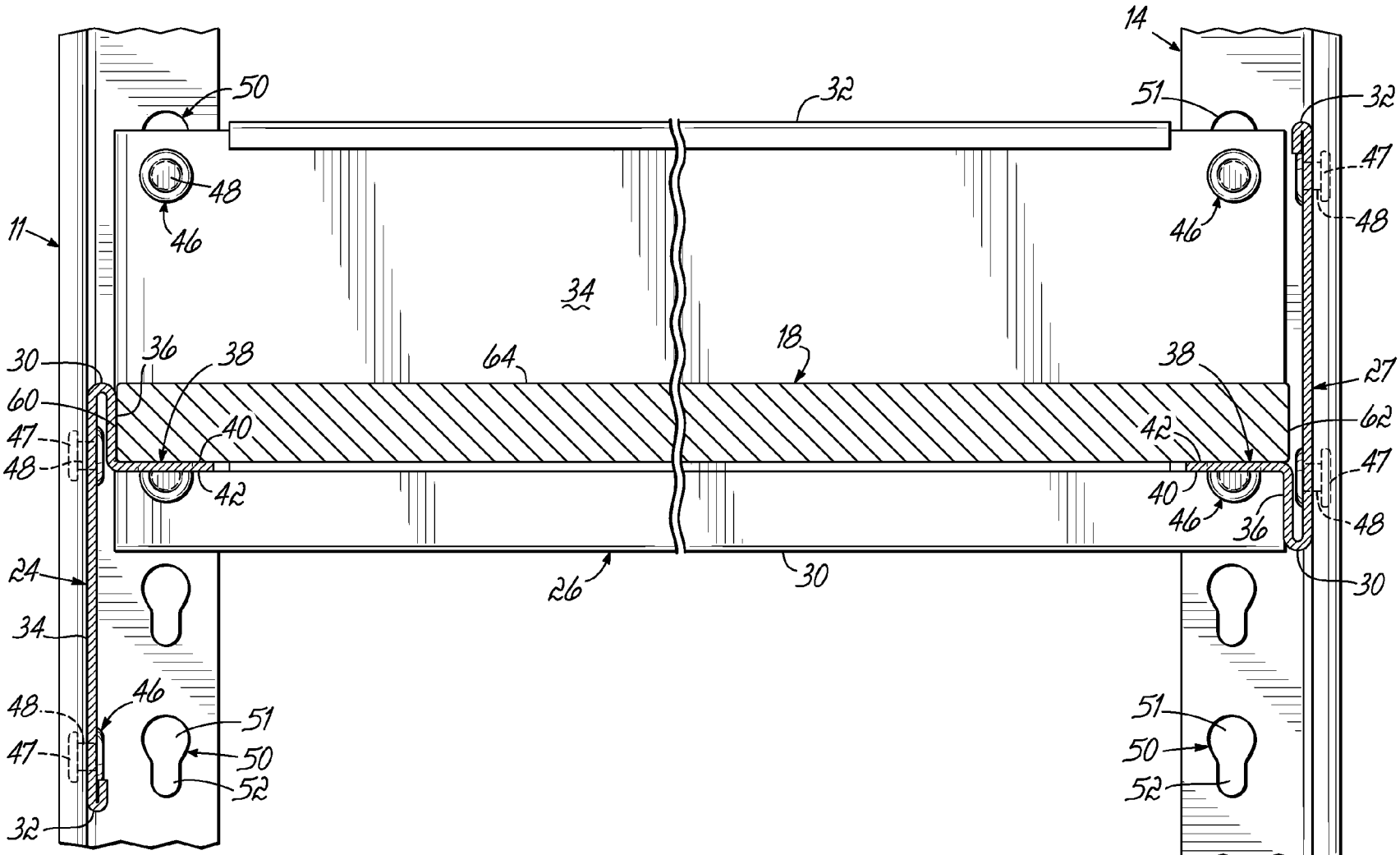
FIG. 4C is a cross-sectional view taken along lines 4C-4C of FIG. 1.

FIG. 4C illustrate a cross-section of shelf 18 wherein there is a lip along both the sides and the rear of shelf 18. In this configuration, the side beam 25, 26 and rear beam 27 are flipped or oriented so the beam edges 32 are uppermost compared to beam edge 30 which is lowermost. Shelf 18 is supported on surfaces 42 of flanges 38 of beams 25, 26, 27. At the same time, front beam 24 is oriented with its edge 30 uppermost, and shelf 18 lies on surface 40 of flange 38. In this configuration, shelf surface 64 is below all beam edges 32 and flush with beam edge 30 of beam 24, leaving a front shelf side with no lip, and shelf sides and back with an upstanding lip.

Figure 4D:
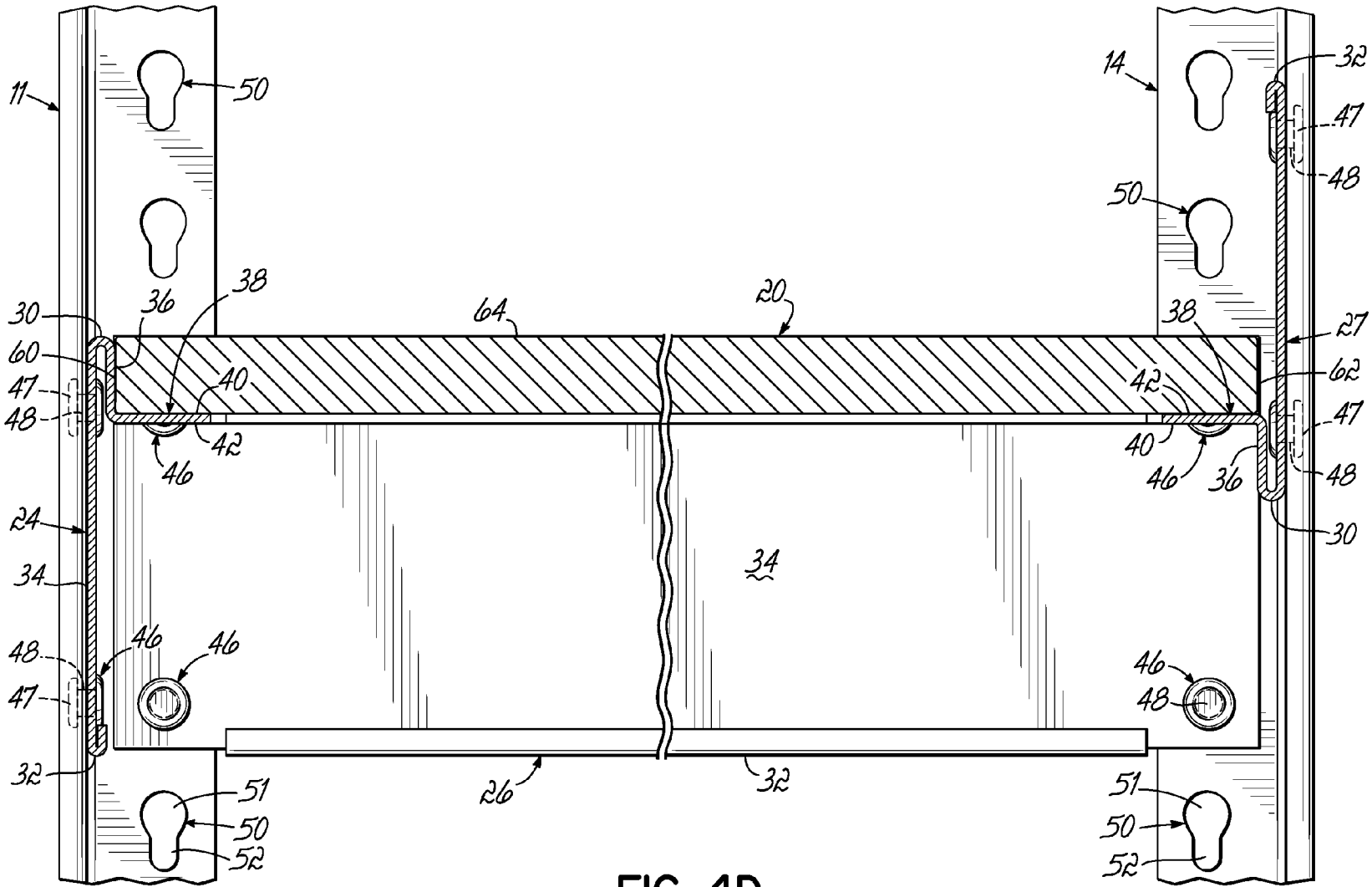
FIG. 4D is a cross-sectional view taken along lines 4D-4D of FIG. 1.

FIG. 4D illustrates a cross-section of shelf 20 where the rear side of shelf 20 has an upstanding lip, but the front and rear sides have no lip. In this configuration, only rear beam 27 is flipped with its edge 32 uppermost over edge 30, while beams 24, 25 and 26 are in a different configuration with edge 30 uppermost providing flush shelf front and sides. Here, shelf 20 is supported on surface 42 of flange 38 of beam 27, but on surfaces 40 of flanges 38 of beams 24, 25, 26.

The length of beams 24-27 is such that while the respective beam ends are functionally coupled to the respective columns 11-14, the beams 24-27 do not interfere one with the other, regardless of their orientation.

Figure 5A:
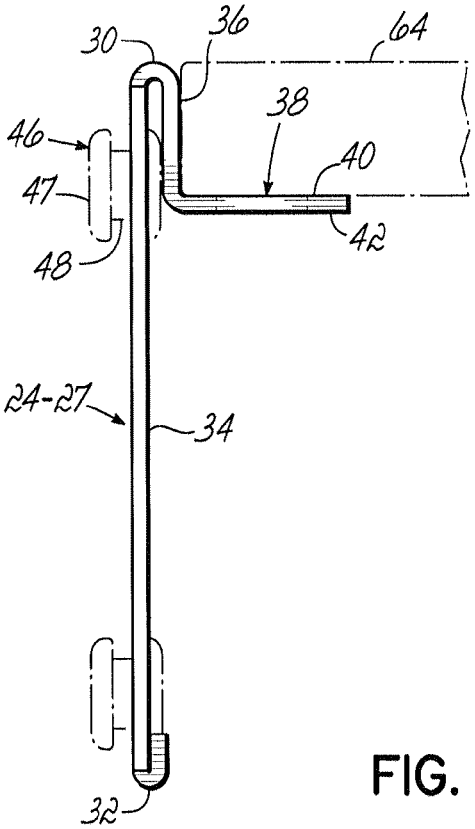
FIG. 5A is an illustrative cross-section of a shelf-supporting beam wherein the top edge 30 of the beam is flush with the flat edge surface.
Figure 5B:
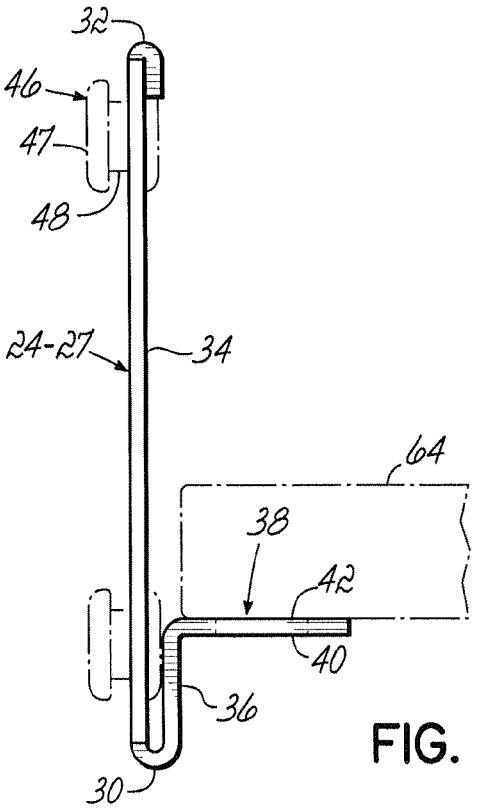
FIG. 5B is an illustrative cross-section of a shelf-supporting beam, wherein the beam is flipped over, or reversed, the shelf residing on the opposite side of the support flange and the now upper beam edge extending above a shelf surface, forming an upstanding lip or edge for the shelf.

The cross-sections of FIGS. 5A, 5B are illustrative of the two varied configurations of a beam with respect to a shelf.

Accordingly, it will be appreciated that in a shelf apparatus 10, where a predetermined number of shelves are desired, the configuration of the shelf edges being flush or with upstanding lips is dependent on the orientation of the common side beams and common front and rear beams and not on the shelves 16-20 themselves. Thus, where a variety of shelving configurations are desired, the invention facilitates that configuration with only the same number of parts (columns, shelves and beams) as if the desired configurations were all identical.

Figure 2:
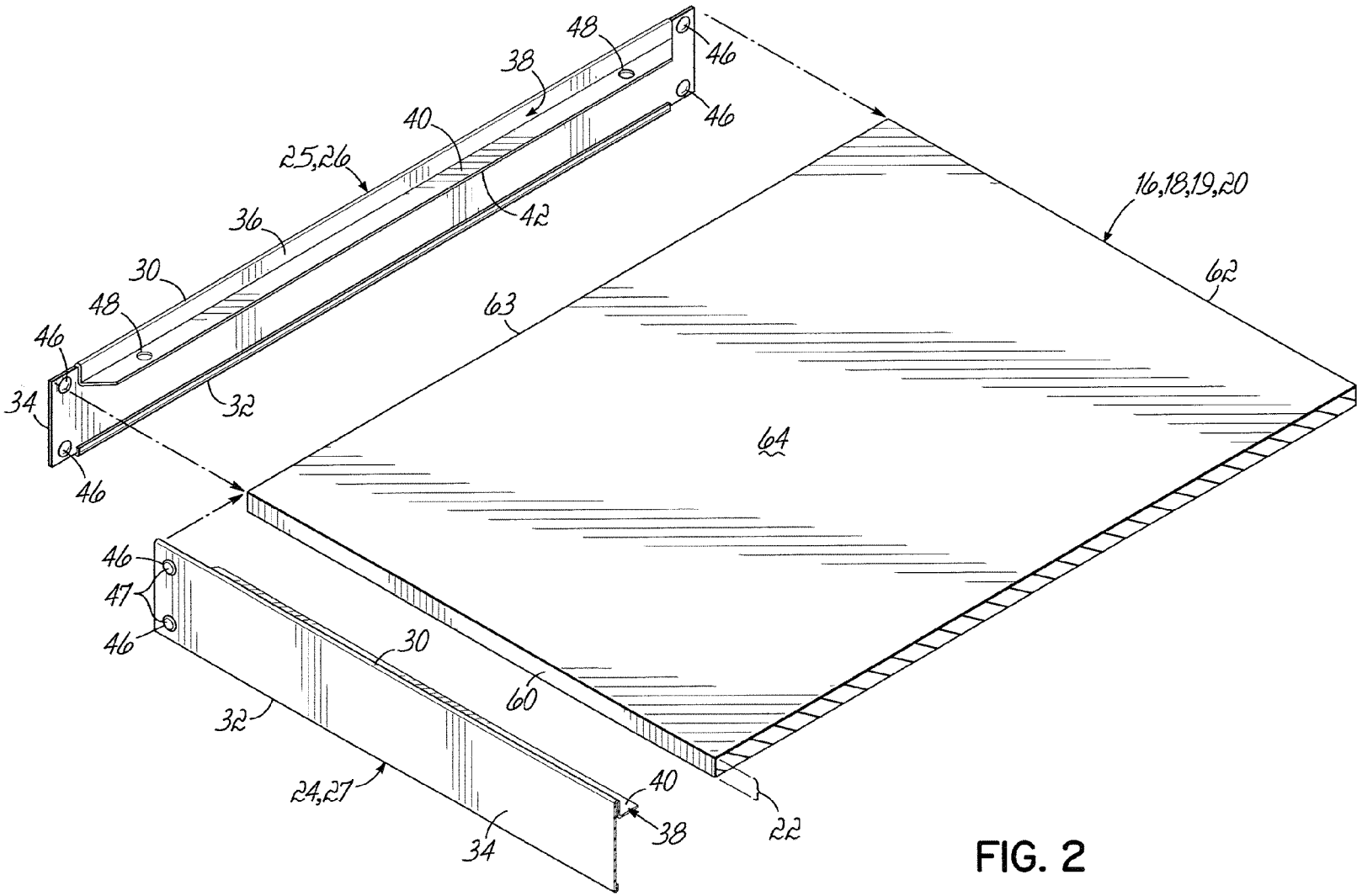
FIG. 2 is an exploded isometric view of the invention illustrating a shelf or two shelf-supporting beams wherein the top edges of the beams are flush with the shelf surface.

It will be appreciated that for purposes of description a shelf in the invention has a flush edge configuration when the shelf side or portion is alongside a beam in a first position, as in FIGS. 2 and 3. That same shelf has a lipped edge configuration along a portion thereof adjacent a beam which is in a reversed second position, such as the beams 24, 27 in FIG. 4B.

Finally, it will be appreciated that the invention contemplates methods of assembling a shelf apparatus wherein columns are erected vertically, front side and rear bears of a set of beams are connected to respective columns in one of two reversible positions, such that beams in one position have an upper edge flush with a shelf surface when a shelf is laid thereon, and when the beams are reversed, the now upper bottom edge extends above a surface of a shelf laid on the beam to provide an upstanding lip above the shelf surface. Any combination of beam orientations can be used to provide a lip for a shelf edge or a flush shelf edge.

These and other modifications and variations of the invention will be readily appreciated by the foregoing to those of ordinary skill in the art without departing from the scope of the invention and applicant intends to be bound only by the claims appended hereto.

What is claimed is:

1. A shelving apparatus comprising:

a plurality of support columns;

a plurality of shelves, each having an upper shelf surface;

a plurality of shelf-supporting beams attachable to respective ones of said columns for supporting a respective shelf with said upper shelf surface extending in one horizontal plane;

each of said beams having a top edge and a lower edge and said beams being selectively attachable to said respective columns in one of two selected positions;

said beams each including a shelf-supporting flange extending therefrom, each said flange disposed closer to a respective top edge of each said beam than to a respective lower edge of each said beam, and each said flange having first and second opposed shelf supporting surfaces;

in a first position, said top edge of a beam is disposed above said lower edge thereof, and in a second position, said lower edge of a beam is disposed above said top edge;

said top edge of a respective beam being flush with said upper shelf surface in said plane when said respective beam is attached to said respective columns in said first position and said shelf is disposed on said first shelf supporting surface of said flange of said respective beam, and said lower edge of another respective beam being disposed above said upper shelf surface in said plane wherein said other beam is attached to said respective columns in said second position and said shelf is disposed on said second shelf supporting surface of the flange of said other respective beam;

said shelves each being supported by four of said beams independently attached to said support columns, each of said four beams oriented respectively in any of said first or second positions independently of the orientation of any of the other of said four beams, with said upper shelf surface disposed in said horizontal plane.

2. A shelf apparatus as in claim 1 wherein at least one of said beams defines an upstanding lip along an adjacent shelf and above said upper shelf surface, when said at least one beam is attached to respective columns in said second position.

3. A shelf apparatus as in claim 1 wherein said beams include a web and a reverse fold flange bent over from said web of said beams, said shelf-supporting flange of each beam extending perpendicularly and away from said reverse fold flange of said beams.

4. A shelf apparatus as in claim 1 wherein said shelf-supporting flange is oriented at a first distance from the top edge of said beams approximately equal to a thickness of a shelf.

5. A shelf apparatus as in claim 4 wherein said shelf-supporting flange is oriented at a second distance from said lower edge of said beams, which second distance is greater than said thickness of said shelf.

6. A shelving apparatus as in claim 1 wherein selected beams in said apparatus are in said first position and other selected beams in said apparatus are in said second position.

7. A shelving apparatus as in claim 6 wherein said shelves define flush edges along portions of adjacent beams in said first position and wherein upstanding lips are defined by adjacent beams in said second position along other portions of said shelves.

8. A shelving apparatus comprising:

a plurality of support columns;

a plurality of shelves, each having an upper shelf surface;

a plurality of shelf-supporting beams attachable at ends thereof to respective ones of said support columns for supporting a respective shelf with said upper shelf surface extending in a first horizontal plane;

each of said beams having an upper and a lower edge and including at respective ends thereof a rivet for interconnection to one of said support columns, said beams being selectively disposed in a first position with said upper edge disposed upwardly or in a second position with said lower edge disposed upwardly;

a shelf-supporting flange extending from and along each of said beams;

said flange being disposed closer to said upper edge than a lower edge;

said beams being connected to said columns such that said upper shelf surface is in said first horizontal plane when supported both by a beam flange of a beam in said first position, and when supported by a beam flange of a beam in said second position; and wherein said upper edge of said beam is flush with said upper shelf surface when said beam is in said first position.

9. Apparatus as in claim 8 wherein said apparatus includes a shelf supported by one beam in said first position and by another beam in said second position with said upper shelf surface in said plane.

* * * * *